US009763502B2

(12) United States Patent
Rudin

(10) Patent No.: US 9,763,502 B2
(45) Date of Patent: Sep. 19, 2017

(54) WALKING STICK WITH S-SHAPED FLEXURE MECHANISM TO STORE AND RELEASE ENERGY

(71) Applicant: Neal H. Rudin, Rochester, NY (US)

(72) Inventor: Neal H. Rudin, Rochester, NY (US)

( * ) Notice: Subject to any disclaimer, the term of this patent is extended or adjusted under 35 U.S.C. 154(b) by 0 days.

(21) Appl. No.: 14/273,527

(22) Filed: May 8, 2014

(65) Prior Publication Data

US 2014/0332045 A1 Nov. 13, 2014

Related U.S. Application Data

(60) Provisional application No. 61/821,198, filed on May 8, 2013.

(51) Int. Cl.

| | |
|---|---|
| ***A45B 9/04*** | (2006.01) |
| ***A61H 3/02*** | (2006.01) |
| ***A45B 7/00*** | (2006.01) |
| *A45B 9/02* | (2006.01) |
| *A45B 9/00* | (2006.01) |

(52) U.S. Cl.

CPC ..... *A45B 9/04* (2013.01); *A45B 7/005* (2013.01); *A61H 3/0288* (2013.01); *A45B 9/02* (2013.01); *A45B 2009/007* (2013.01); *A45B 2200/055* (2013.01)

(58) Field of Classification Search

CPC .. A45B 9/04; A45B 2200/055; A61H 3/0277; A61H 3/0288

USPC ..... 135/82, 86

See application file for complete search history.

(56) References Cited

U.S. PATENT DOCUMENTS

| | | | | |
|---|---|---|---|---|
| 7,954,502 | B2 * | 6/2011 | Townsend | A61H 3/02 135/66 |
| 2004/0107981 | A1 * | 6/2004 | Smith | A45B 9/00 135/65 |
| 2004/0250845 | A1 * | 12/2004 | Rudin | A45B 7/005 135/77 |
| 2005/0016572 | A1 * | 1/2005 | Townsend | A61F 2/60 135/75 |
| 2006/0185703 | A1 * | 8/2006 | Townsend | A61H 3/02 135/82 |
| 2010/0206348 | A1 * | 8/2010 | Markou | A61H 3/02 135/71 |
| 2011/0061699 | A1 * | 3/2011 | Parry | A45B 7/00 135/82 |

FOREIGN PATENT DOCUMENTS

| | | | | |
|---|---|---|---|---|
| DE | 202011103635 | U1 * | 7/2013 | A61H 3/02 |

* cited by examiner

*Primary Examiner* — Noah Chandler Hawk
(74) *Attorney, Agent, or Firm* — Bassett IP Strategies; David F. Bassett

(57) ABSTRACT

A walking stick that takes inspiration from nature to absorb energy in the downward first motion of a walking stride and then return the stored energy to aid in propelling the walker forward in the final forward motion of the walking stride all the while keeping the walker in an ergonomically correct position which minimizes discomfort and reduces wasted energy. The walking stick that is the subject of this patent application utilizes a dual flexure spring configured in an S-shape (hereafter referred to as an S-flexure spring) as an extension of the straight shaft of the stick. The shape and location of the S-flexure spring are such that the spring force helps propel the walker forward.

17 Claims, 14 Drawing Sheets

WALKING STICK WITH S-SHAPED FLEXURE MECHANISM TO STORE AND RELEASE ENERGY

CROSS-REFERENCE TO RELATED PATENT APPLICATIONS

Priority for this patent application is based upon provisional patent application 61/821,198 (filed on May 8, 2013) and non-provisional patent application Ser. No. 14/273,527 (filed on May 8, 2014). The disclosure of these United States patent applications are hereby incorporated by reference into this specification.

FIELD OF THE INVENTION

The invention relates in general to mobility aid sticks and, more specifically, to a walking stick with a built in a dual flexure spring above the foot of the walking stick.

BACKGROUND OF THE INVENTION

Walkers, climbers, and other participants can benefit from walking sticks that have the feature of returning kinetic energy that is acquired as the walking stick compresses in contact with the ground. This retained energy has the benefit that the users have to expend less of their own energy moving their legs forward, thus allowing them to walk or climb further and faster more comfortably and with less fatigue. Experiencing this advantage, the user will increase their interest in the activity and become a more active person.

The use of a walking stick with an energy storage spring for returning energy to the walker is well known to those familiar with the art. An example is the use of energy storage springs in foot prosthesis; particularly those used for athletic purposes. Designs include that of U.S. Pat. No. 6,007,582 or that in use in the Flex-Foot®, manufactured by Ossur hf of Reykjavik, Iceland. Examples where a spring mechanism stores and then sequentially dissipates energy for the sole purpose of cushioning a walking stick are described in U.S. Pat. No. 6,131,592, U.S. Pat. No. 5,720,474, and FR2617023. These walking sticks utilize a mechanical device such as a coil spring or cylinder for a spring and do not make use of the compression of a flexure to return the energy from the material compressing as a step is taken.

A published paper entitled "The design of a compliant composite crutch" by D. Shortell et al. discloses two designs of crutches using composite materials. The first design utilizes a metal coil spring embedded in a single unit composite material crutch. The coil spring compresses under the weight of the user with a spring force in the range of 90 to 170 lbs. The spring force, which acts in the vertical direction, is for shock absorption, not as a forward propelling aid. A second crutch design utilizes the flexure of the S curve in the shaft of the crutch in place of the coil spring. The effective springs that are designed using the composite material in place of the coil spring also operate in the vertical direction for shock absorption, not as a forward propelling aid. Another feature of the crutches that are the subject of the Shortell et al. publication is a rigid armrest with a grip. These armrests are oriented in the vertical direction for the purpose of providing the user with more support.

Bio-mimicry is the study and emulation of nature and its processes and elements to draw inspiration in order to solve human problems. The term bio-mimicry takes roots from the Greek words bios, meaning life, and mimesis, meaning to imitate. Nature has many elegant solutions to adapt to difficult and diverse terrains and climates. For example, mountain goats have evolved feet that allow them to maintain sure-footing on steep, rocky slopes and powerful legs that give them the strength to climb these difficult slopes.

FIG. 1 depicts a walking stick currently available in the art. The walking sticks currently available have evolved from simple straight shafted walking canes and ski poles and do not look to nature for inspiration. The user holds the walking sticks using a "thumbs up" grip wherein the wrists are strained to a vertical position. This is a non-ergonomically sound position which increases strain on the wrists, hands, and forearms and also transfers less energy to the walking sticks themselves per unit of musculature effort. A user will necessarily have the arms extended into positions where their muscles can't transfer maximum leverage to the walking stick to assist with their forward motion. By holding the wrists and forearms in a more natural horizontal position, the user could proportionally output more power to the walking sticks to help propel them over the terrain they are traversing. The present invention takes its inspiration from nature and overcomes the ergonomic issues associated with the prior art.

Standard walking sticks, hiking poles, and ski poles can only assist a person's capability to negotiate a limited number of landscapes and ground conditions. There has been limited evolution of their tips, oftentimes referred to as "ferrules and baskets." The ferrule and basket has been the standard up until now, with minimal design modification other than variations in materials, slight changes in shape, addition of hard points and shock absorbers. A walking stick that could readily accept an interchangeable shoe designed to improve traction on varying terrains would be a major improvement over the current art.

Another limitation of the standard walking stick is the pointed tip of the ferrule. This pointed tip cuts into the surface of the terrain the user is traversing. This contributes to deterioration of the terrain surface as the pointed tip slices through and grabs into the surface. It also causes the user to expend excess energy to remove the tip from the terrain surface and places transverse forces across the walking stick which contributes to walking stick failure (breakage). A walking stick that possessed a dual flexure spring configured in an S-shape would cause less damage to terrain as a user traversed the terrain and would not be susceptible to breaking the shaft due to normal wear.

SUMMARY OF THE INVENTION

In light of the above, the object of the present invention is to provide a walking stick that takes inspiration from nature to absorb energy in the downward first motion of a walking stride and then return the stored energy to aid in propelling the walker forward in the final forward motion of the walking stride all the while keeping the walker in an ergonomically correct position which minimizes discomfort and reduces wasted energy. The walking stick will add an increase in ability of a person to climb and descend steeper slopes and stairways as the strength and agility of the user's arms are available and therefore increases the capability of a person. It is designed to allow a user to be more aggressive and more positively negotiate more complex terrains and surface conditions than is possible with walking sticks currently available. They are fashioned to be more sure-footed through the extraction of principles derived from nature's best examples of foreleg designs. Animals, such a mountain goats, antelope, mountain lions, and tapirs are prime examples of surefooted creatures that rapidly and surefootedly traverse complex terrain.

The walking stick that is the subject of this patent application utilizes a dual flexure spring configured in an S-shape (hereafter referred to as an S-flexure spring) as an extension of the straight shaft of the stick. The shape and location of the S-flexure spring are such that the spring force helps propel the walker forward. The spring constant of the S-flexure spring is in the range of 5 to 100 pounds per inch of deflection. In the preferred embodiment the S-flexure spring is fabricated using composite materials.

The walking stick of the present invention utilizes a hand grip that is large and comfortable and extends nearly perpendicularly from the base of the walking stick inwardly (towards the user) at an angle of approximately 10 to 45 degrees. The natural position that the relaxed hand takes when the arms are held perpendicular to the ground is at an angle of approximately 15 to 30 degrees. In a preferred embodiment the hand grip is fabricated using glass reinforced acrylonitrile butadiene styrene (ABS) plastic covered with a rubberlike material. The handgrip allows a user to keep the wrists in a natural nearly horizontal position which allows for more efficient transfer of force to the S-flexure spring than would be transferred when the wrists are held in a vertical position. In another preferred embodiment the hand grip is fabricated to conform to a user's palm putting the user's hand in an even more natural and relaxed position.

The walking stick of the present invention has a foot at its base. The foot is angled away from the user at an angle of approximately 10 to 45 degrees. The angling of the foot away from the user helps to keep the user from striking his leg against the walking stick as it moves past the user's leg. It also provides the user a wider foundation providing the user a lowered center of gravity which gives the user more balance when traversing difficult (uneven or slippery) terrain. The foot may be bifurcated which allows for improved stability. The user's arms are held closer to the frame of his body than would be possible with walking sticks of the current art, which place the arms in a more natural position and allows for a more relaxed motion. The foot may optionally be fitted with a shoe covering the foot. The shoe is designed to be specific to particular terrain conditions and provides for improved traction and surety of placement when navigating difficult terrain such as slippery stream beds, steep hill sides, glaciers, deserts, forests, mud flats, and the like. As an example, when traversing over icy terrain, the user could attach a shoe with an icy terrain shoe which keeps the walking stick from sliding on the ice.

The location of the S-flexure spring is a key feature of the present invention. The first flex point of the S-flexure spring mimics the flexibility of a human ankle. This spring is angled away from the user and angles the forces away from the center of the body for added stability and absorbs the downward forces to release on the rebound.

The second flex point of the S-flexure spring, the less flexible arch, controls direction of forces. The angle the foot is aligned relative to straight ahead varies from zero degrees for the medical versions of the walking stick to 45 degrees for the extreme sports or military versions of the walking stick.

There is an additional flex point in the foot. This mimics the motion of the "ball of the foot" of a human which keeps the foot flat when it makes contact with the ground while in use. On rebound it helps propel the walking stick forward to its next location.

The walking stick of the present invention may be used in a wide number of applications. Examples include a walking and climbing stick for hikers and combat troops, an ambulatory aid for a person recovering from surgery or otherwise limited in ability to walk, a substitute for a ski pole for cross country skiing, a pole for use in roller blading, a hiking stick that will also function as a canoe paddle, or a walking stick for snow shoeing. It may be a molded single unit or assembled out of multiple components. As a molded single unit the flexure spring is integral to the molded stick. As a stick built of multiple components, the flexure spring is attached to the straight shaft of the stick and may be interchangeable depending upon the size and weight of the user, or depending on one of the specific uses listed above.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, relative proportions depicted or indicated of the various elements of which disclosed members are comprised may not be representative of the actual proportions, and some of the dimensions may be selectively exaggerated.

DETAILED DESCRIPTION OF THE INVENTION

Figure 1:
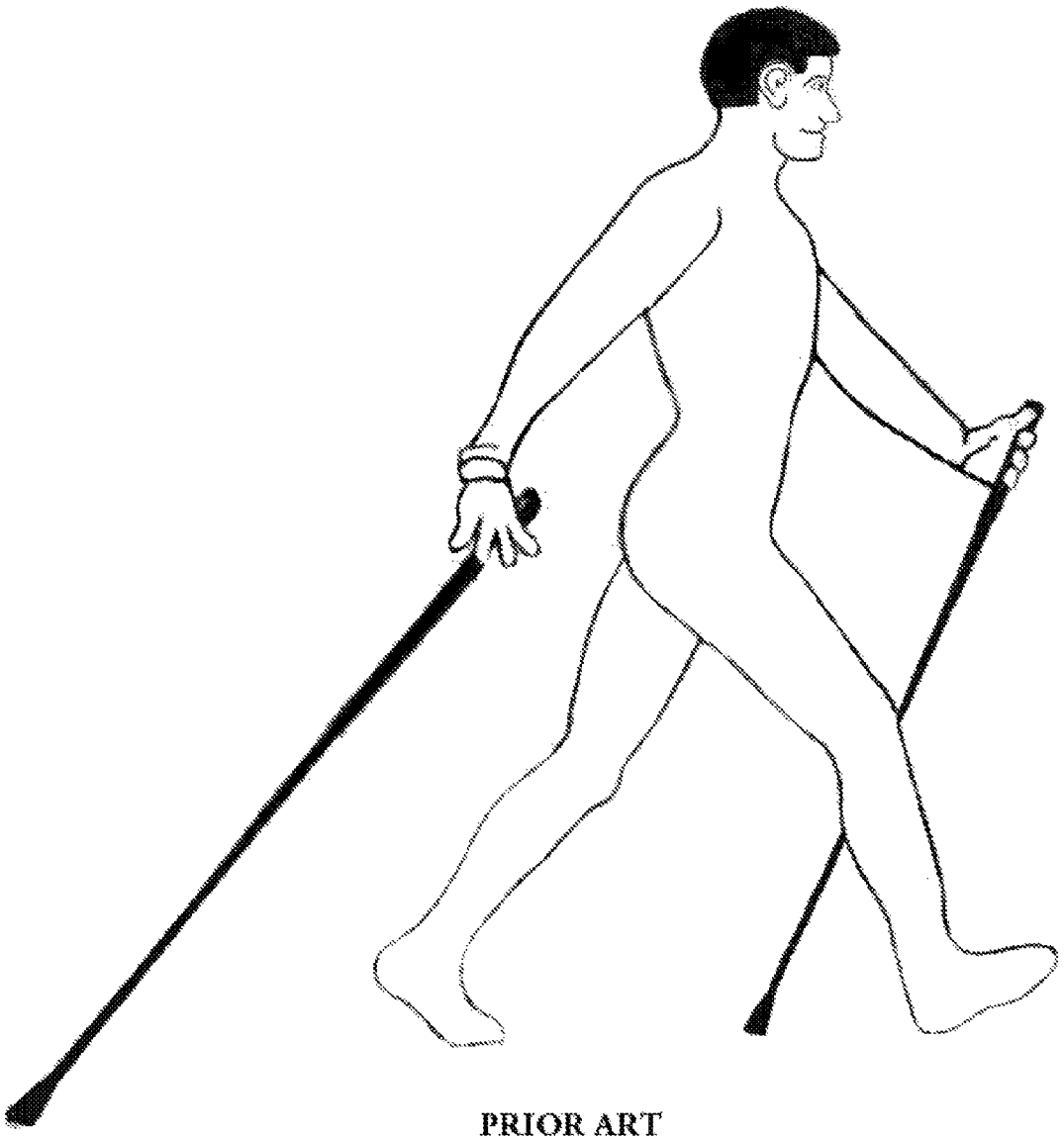
PRIOR ART FIG. 1
FIG. 1 illustrates a standard walking stick and a hiker using said walking stick.
Figure 2:
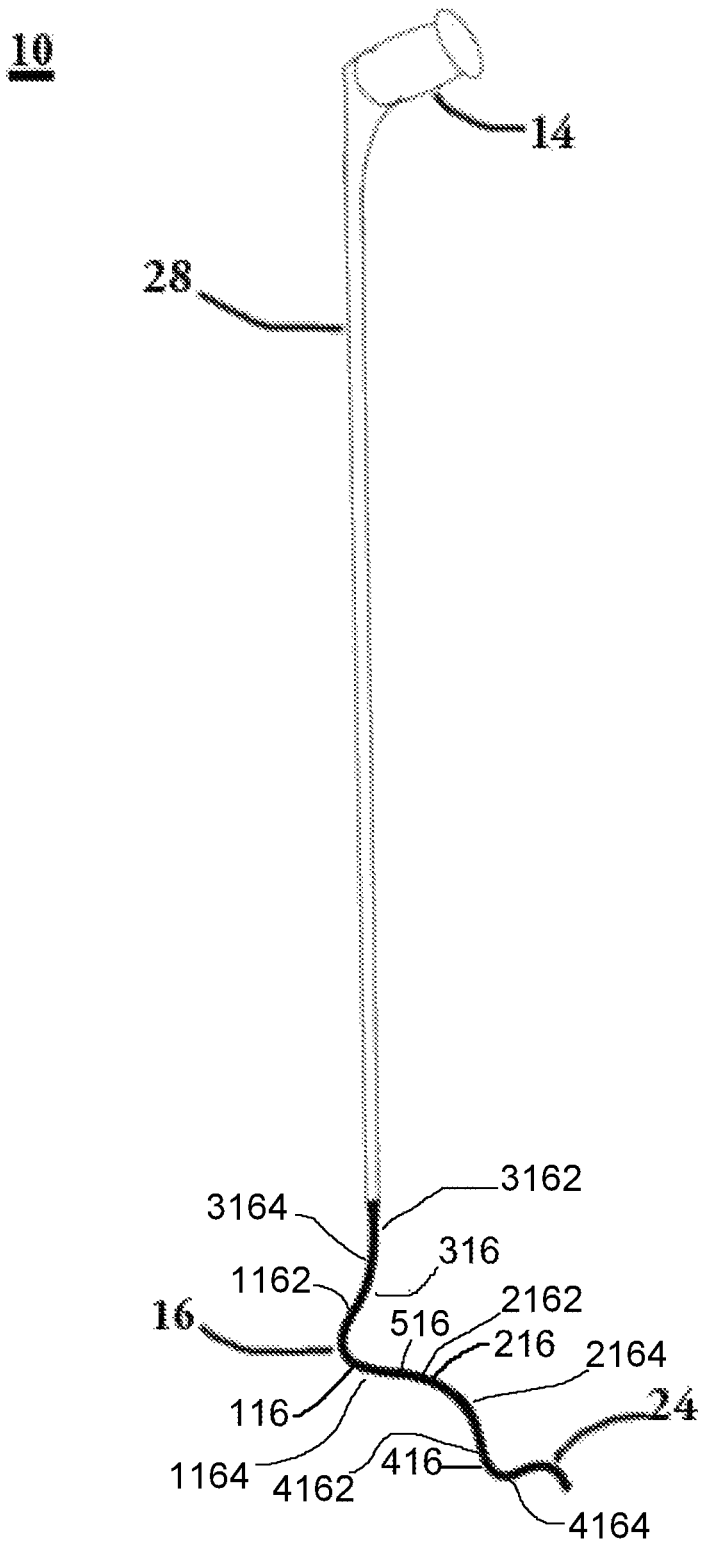
FIG. 2 illustrates a single-piece walking stick.

Referring to FIG. 2, therein is shown a preferred embodiment of the invention. This walking stick, generally designated by numeral 10, is molded as a single unit of fiberglass, carbon, aircraft aluminum, or other composite material. The appropriate material will be selected to achieve desired duty cycle and performance characteristics. Walking stick 10 includes a straight shaft 28 terminated at the upper end with a handgrip 14 and at the lower end with an S-flexure spring 16 and optionally a foot 24. Walking stick 10 may be constructed of ceramic, laminated linear fiberglass, aircraft aluminum, or other composite material. As those skilled in the art of extrusion molding are aware, the S-flexure spring 16, the foot 24, the straight shaft 28, and the handgrip 14 may be molded of laminated linear fiberglass as a single unit by adjusting the thickness and orientation of the premolded composite material at the appropriate positions along the length of the walking stick. In a preferred embodiment walking stick 10 is constructed of a fiberglass tape such as that manufactured by the Fibreglast Development Corp. of Brookville, Ohio, USA. The S-flexure spring 16 comprises two flexures, an upper flexure 116 and a lower flexure 216. This upper flexure 116 is also referred to in this specification as the first curve and the first flex point and the lower flexure 216 is also referred to in this specification as the second curve and the second flex point. The first curve 116 will comprise a pair of curves 1162 and 1164 entering and leaving the curve 116. The second curve 216 will comprise a pair of curves 2162 and 2164 entering and leaving the curve 216. Within the curves of the S-flexure spring 16, there is an inflection point 516 located between curves 1164 and 2162 wherein the flex of the spring alters from forward facing to rearward facing. As previously stated, the S-flexure spring mimics the flexing of the ankle and foot. It is this inflection point that allows the S-flexure spring 16 to mimic the flexing of the ankle and foot. As those skilled in the art are aware for a walking stick comprised of a single component, an additional flexure 316 will be formed at the point where the S-flexure spring 16 meets the straight shaft 28. This additional flexure 316 will be curved and will comprise a pair of curves 3162 and 3164 entering and leaving the centrality of the curve of the additional flexure 316. For a walking stick wherein each component of the walking stick (straight shaft, handgrip, S-flexure spring, and foot) are manufactured separately and then joined together in a finishing step the additional flexure 316 may be replaced by an angular coupling of two straight pieces.

Figure 3:
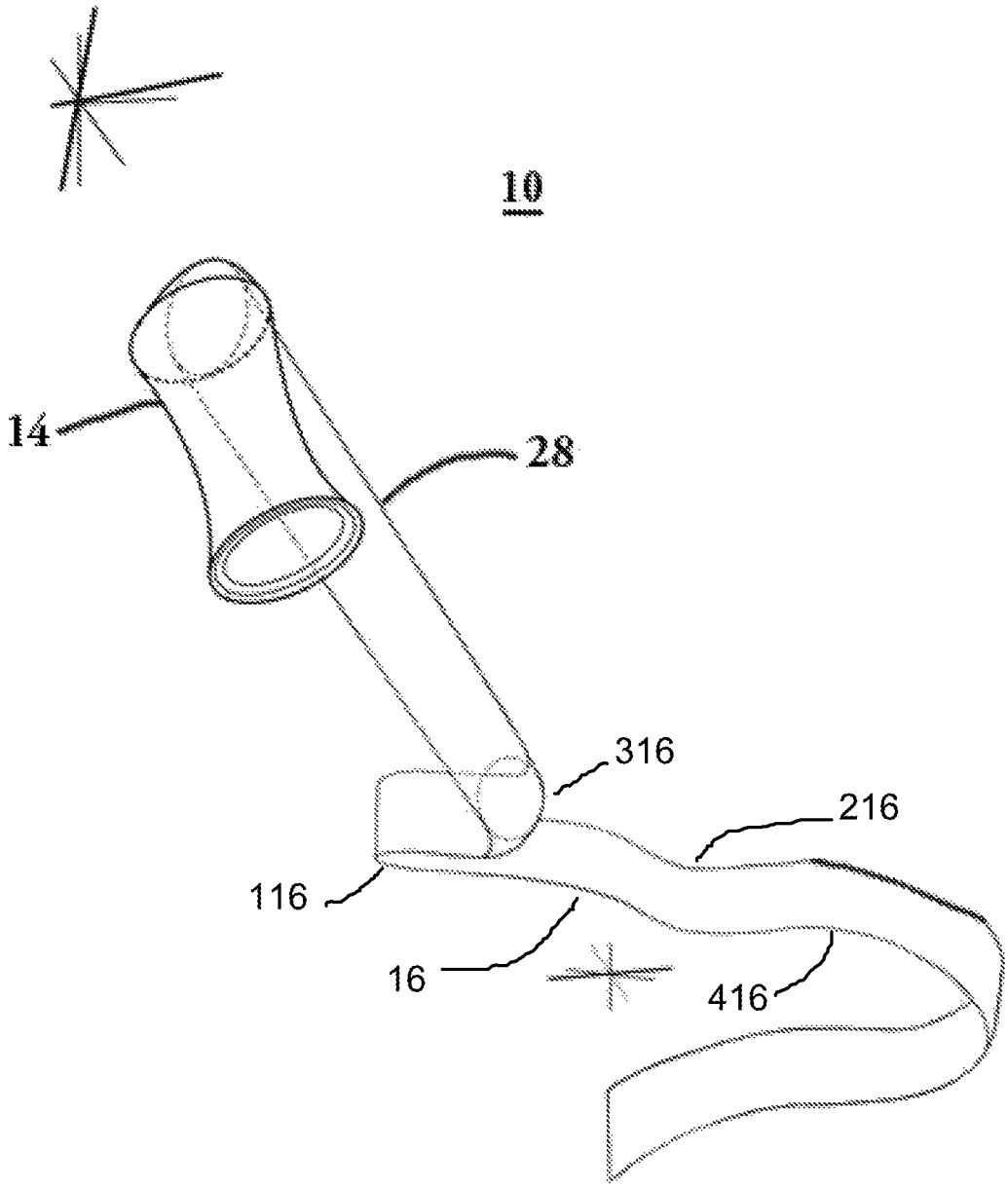
FIG. 3 illustrates an overhead view of a walking stick (for orientations).
Figure 4A:
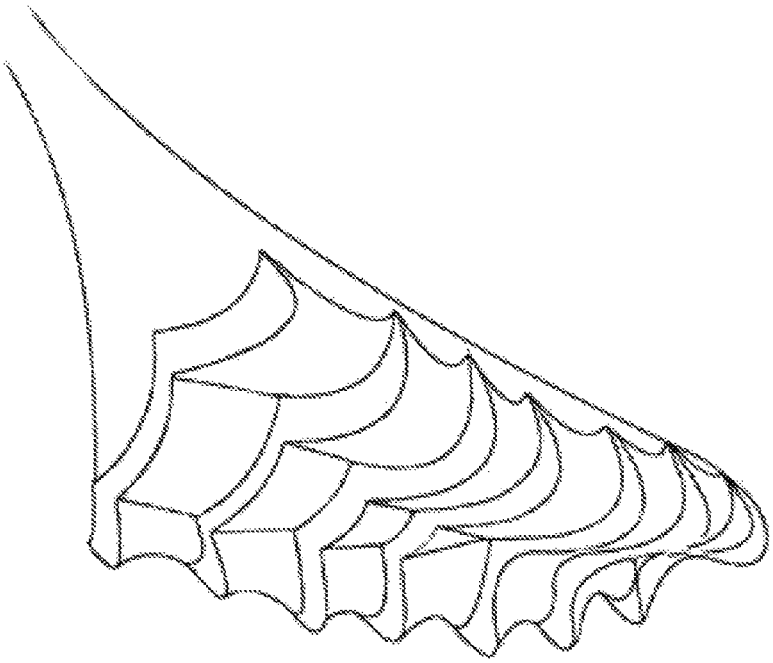
FIGS. 4A-4D illustrate multiple shoes that may be used with a walking stick.
Figure 4B:
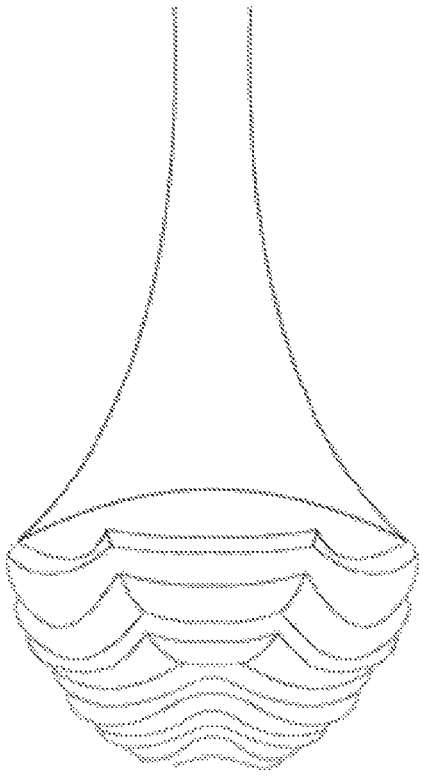
Figure 4C:
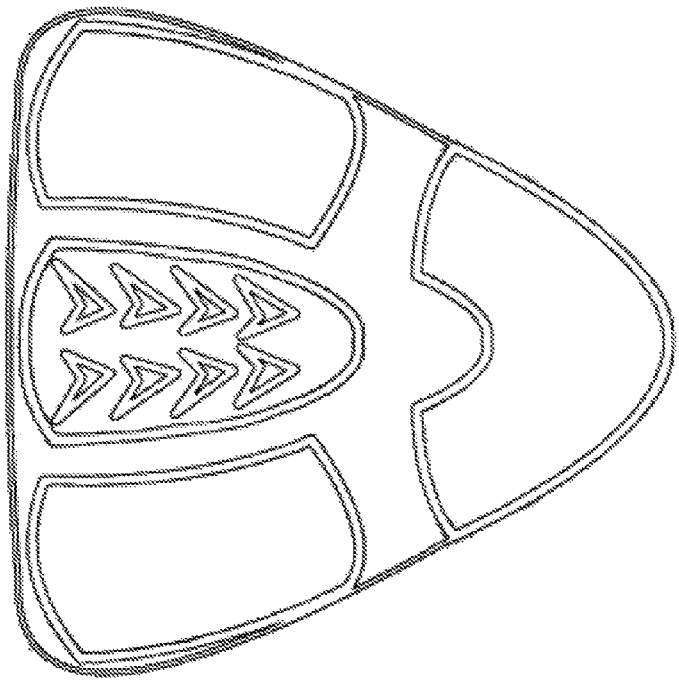
Figure 4D:
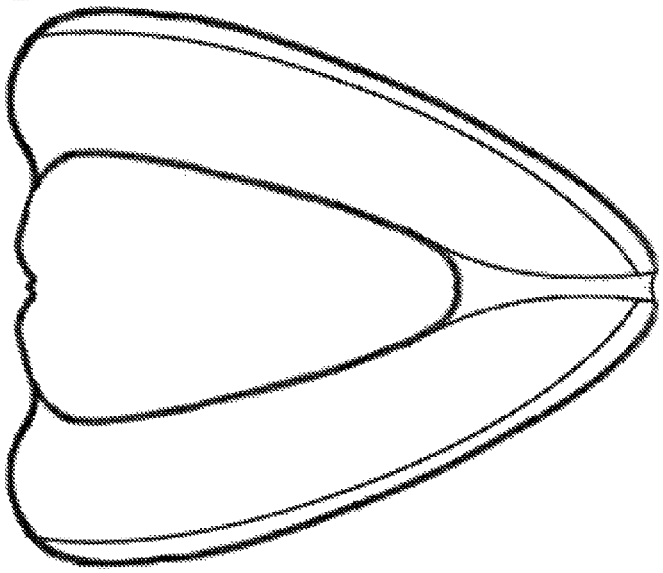

An overhead view of the walking stick 10 is provided in FIG. 3. As shown in FIG. 3, the handgrip 14 meets the straight shaft 28 in a manner such that the user's hand will be oriented in a horizontal position and rotated inwardly (towards the user) slightly to a position of approximately 15 to 30 degrees.

Referring again to FIG. 2 and the preferred embodiment therein, at the base of the walking stick 10, below the S-flexure spring 16, at the point where S-flexure spring 16 would contact the walking surface, is a foot 24. As those skilled in the art are aware, another additional flexure 416 will be formed at the point where the S-flexure spring 16 meets the foot 24 for a one-piece walking stick. This additional flexure 416 will be curved and will comprise a pair of curves 4162 and 4164 entering and leaving the centrality of the curve of the additional flexure 416. The purpose of foot 24 is to prevent S-flexure spring 16 from sliding on the walking surface. The walking stick 10 may assist a user in a variety of different terrains. An economical and efficient way to accommodate for the constantly varying needs of the user, as they traverse a diverse topography, is to use a "universal foot" and have a variety of shoe attachments mimicking animal feet. A user can attach the correct shoe for negotiating the varying ground conditions rapidly with little effort. Foot 24 may be fitted with a replaceable shoe (not depicted in FIG. 2). Replaceable shoe may be made from synthetic rubber, such as, for example, butyl compounds and synthetics such as polyurethane and vinyls, or any other material with a suitable coefficient of friction with the walking surface. FIG. 4A-D provides representative examples of replaceable shoe for a variety of terrain conditions. Table 1 provides a representative listing of preferred replaceable shoe shape and sole pattern for the variety of terrain conditions and identifies each replaceable shoe. As should be readily apparent to those skilled in the art, there are several additional materials and shapes which may be used to improve a user's traction in the variety of terrain conditions encountered and the examples cited should not be considered to be limiting.

TABLE 1

| Terrain Condition | Exemplary Material | Exemplary Shape | FIG. Illustration |
|---|---|---|---|
| Marshy/Muddy/ Wet | Overmolded rubber (Urethane) | Duck | 4A |
| Hilly/Rocky | Rubber, Vinyl with impregnated materials, Overmolded hard metal | Mountain Goat | 4B |
| Snow/Ice | Rubber | Snow leopard Snowshoe Rabbit Bobcat | 4C |
| Sand | Rubber | Camel | 4D |
| Pavement | Rubber | Horse | Not Depicted |
| Dense woods | Rubber | Leopard | Not Depicted |

The shoe is fitted over the foot and remains connected until user decides to change it out. Alternatively, a single non-removable she may be fitted over the foot.

Figure 5:
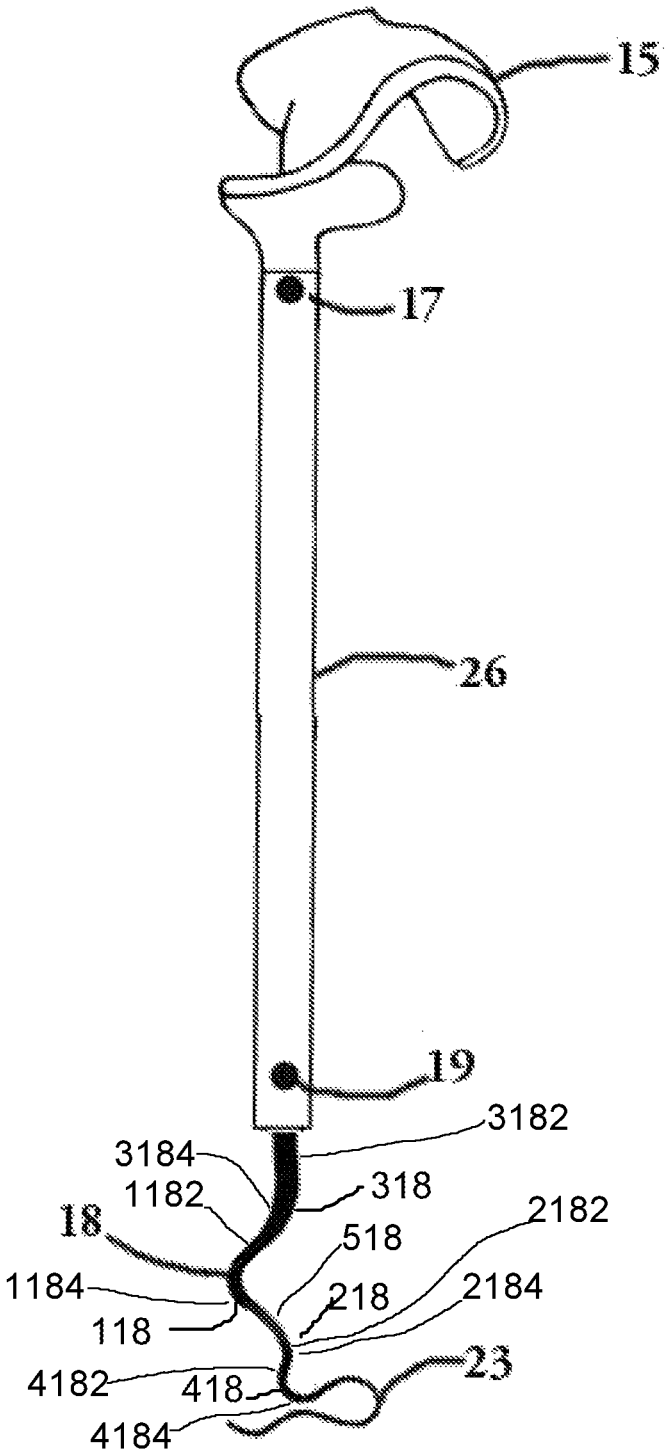
FIG. 5 illustrates a multi-piece walking stick.

Many animals have feet with an opposable dewclaw located near the ankle. This dewclaw provides the animal additional traction when walking, especially when the animal is walking down a slope, as the dewclaw can grab into the surface. The replaceable shoe may be constructed with a dewclaw attached. There are several readily available methods for adding a dewclaw to the replaceable shoe which are well known to those skilled in the art. These methods include, but are not limited to, molding a dewclaw in a single piece molded shoe or fastening a dewclaw to the shoe via a rivet or screw and nut or other readily available fastener. Another embodiment of the walking stick of the present invention is shown in FIG. 5 and designated generally as numeral 30. Walking stick 30 in FIG. 5 includes similar sections as walking stick 10 in FIG. 2, that is, a straight shaft 26, a handgrip 15, an S-flexure spring 18, and a foot 23, but the sections of walking stick 30 are separate assembled parts instead of molded as a single unit. In the walking stick 30 embodiment S-flexure spring 18 is constructed of laminated linear fiberglass, other composite material, bamboo, or the like. The S-flexure spring 18 comprises two flexures, an upper flexure 118 and a lower flexure 218. This upper flexure 118 is also referred to in this specification as the first curve and the first flex point and the lower flexure 218 is also referred to in this specification as the second curve and the second flex point. The first curve 118 will comprise a pair of curves 1182 and 1184 entering and leaving the curve 118. The second curve 218 will comprise a pair of curves 2182 and 2184 entering and leaving the curve 218. Within the curves of the S-flexure spring 18, there is an inflection point 518 located between curves 1184 and 2182 wherein the flex of the spring alters from forward facing to rearward facing. Straight shaft 26 may also be constructed of laminated linear fiberglass or other composite material or of any other rigid material such as, for example, aircraft grade aluminum, steel, stainless steel, ceramic, bamboo, or the like. Handgrip 15 is constructed of hard rubber, wood, or any other similar material. In the embodiment depicted the handgrip is molded to conform to a user's palm. S-flexure spring 18 and handgrip 15 are connected to opposite ends of straight shaft 26 by pins 19 and 17 respectively. S-flexure spring 18 of the walking stick 30 embodiment also has attached to it a foot 24, the same as in the walking stick 10 embodiment. As those skilled in the art are aware for a walking stick comprising a curvilinear spring or a multiple curvilinear spring such as the S-flexure spring 18, an additional flexure 318 may be formed at the point where the S-flexure spring 18 meets the straight shaft 26. This additional flexure 318 will be curved and will comprise a pair of curves 3182 and 3184 entering and leaving the centrality of the curve of the additional flexure 318. For a walking stick wherein each component of the walking stick (straight shaft, handgrip, S-flexure spring, and foot) are manufactured separately and then joined together in a finishing step the additional flexure 318 may be replaced by an angular coupling of two straight pieces. As those skilled in the art are aware, another additional flexure 418 may be formed at the point where the S-flexure spring 18 meets the foot 24 for a one-piece walking stick. This additional flexure 418 will be curved and will comprise a pair of curves 4182 and 4184 entering and leaving the centrality of the curve of the additional flexure 418. As those skilled in the art are further aware, for a walking stick comprising multiple pieces rather than a single one piece construction this additional curve 418 may be replaced by an angular coupling of two straight pieces.

Figure 6:
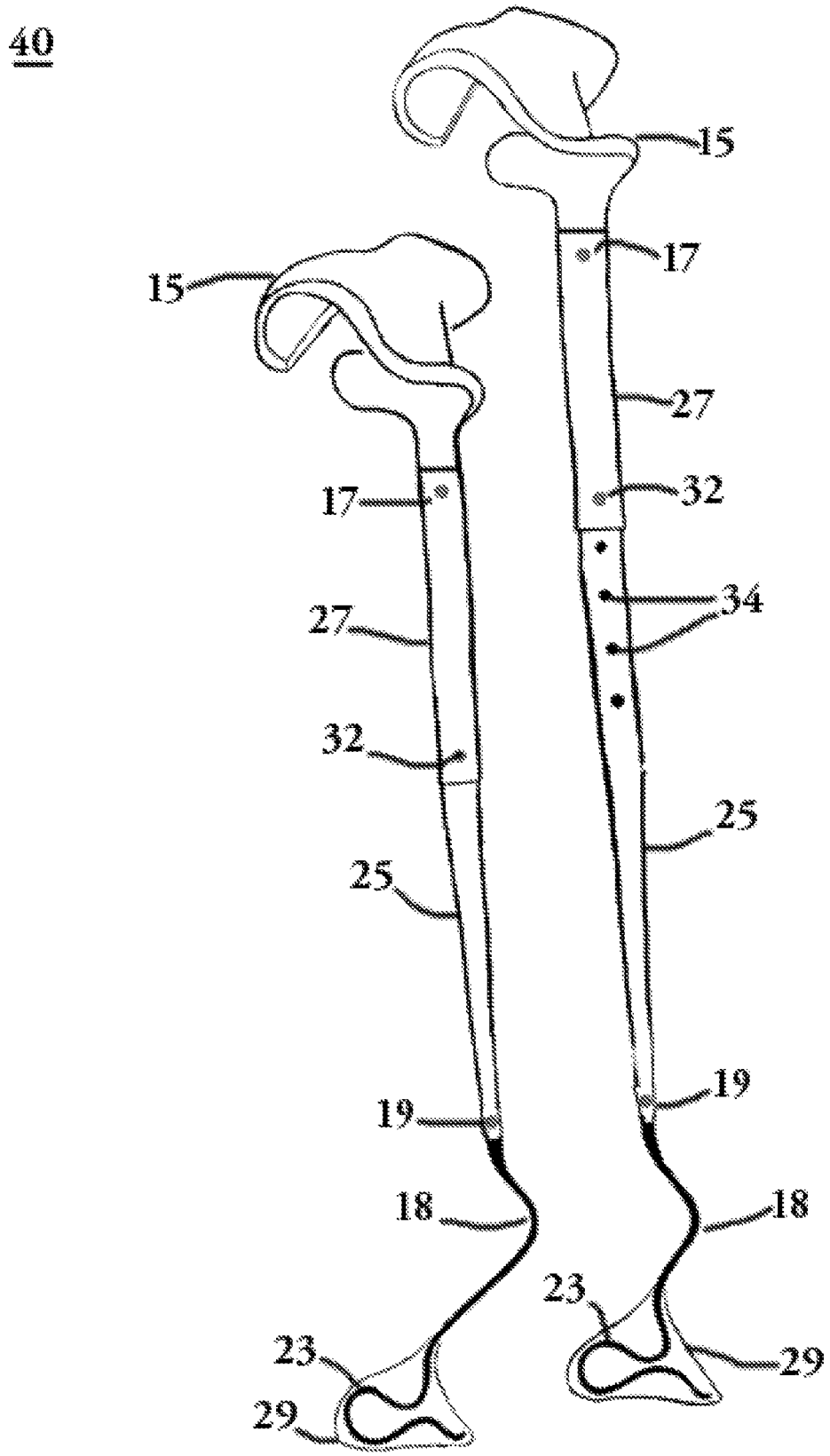
FIG. 6 illustrates a multi-piece walking stick with adjustable length.

For some applications, such as hill climbing, stair climbing, and trekking, an adjustable length walking stick is preferred. Referring to FIG. 6, therein is shown a design of an adjustable length walking stick 40 with the walking stick 40 presented at 2 different adjustments. The walking stick 40 embodiment has the same S-flexure spring 18 with pin 19, and handgrip 15 with pin 17 as the walking stick 30 embodiment of FIG. 5. The straight shaft of the walking stick 40 embodiment includes two telescoping sections 25 and 27. Several means for locking the adjusted length of sections 25 and 27 are known in the art, one of which is shown in FIG. 6. Section 25 contains a spring-loaded pin 32 that is pushed into one of a series of holes 34 in section 27 to secure the desired length of walking stick 40. Other adjustable means can be used such as the mechanism cited in U.S. Pat. No. 5,769,104 (stagelessly adjustable telescopic walking stick with a position retaining device). The entire disclosure of this United States patent is hereby incorporated by reference into this specification. Walking stick 40 also is shown with a shoe 29 attached to foot 23.

Figure 7:
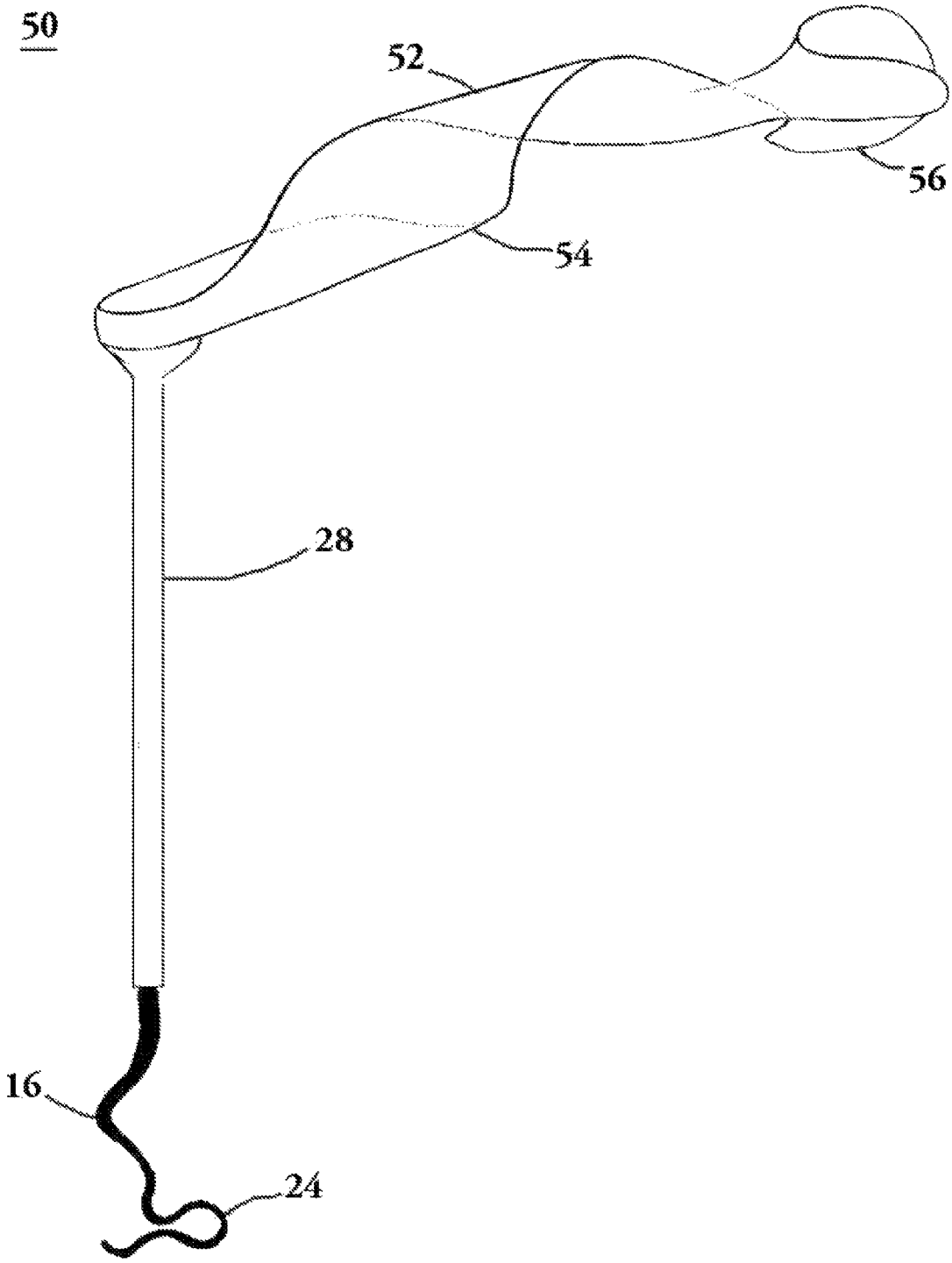
FIG. 7 illustrates a walking stick with a horizontal arm support.

FIG. 7 shows another embodiment of the walking stick of the present invention generally designated by numeral 50. Walking stick 50 is designed to provide additional support to a user's upper body (primarily the forearms) when using the walking stick 50. Walking stick 50 embodiment is distinguished by an adjustable arm support section 52 connected to a vertical straight shaft 28. It is more comfortable and efficient for a user to have the forearm positioned nearly perpendicular to the plane of the terrain being traversed. When traversing level terrain, the adjustable arm support section 52 is connected at an approximate 90 degree angle to the vertical straight shaft 28. The user may adjust the angle between the arm support section 52 and the vertical straight shaft 28 to a comfortable angle which will depending upon the terrain conditions. When traversing up a hill, the user would have the angle between the arm support section 52 and the vertical straight shaft be an acute angle and when traversing down a hill, the user would have the angle be an obtuse angle. Arm support section 52 has a helical arm support 54 and a handgrip 56. Straight vertical shaft 28 and S-flexure spring 16 with foot 24 in the walking stick 50 embodiments are the same as in the walking stick embodiment 10 of FIG. 2. Arm support section 52, with helical arm support 54, of the walking stick 50 embodiments is positioned in the horizontal direction, in line with the natural arm and hand posture used when walking or hiking and helps reduce arm fatigue on long hikes and especially climbing. Arm support section 52 with helical arm support 54 and handgrip 56 may also replace handgrip 15 of the walking stick embodiments of FIGS. 5 and 6, and be molded from plastic. To provide protection for the walker's hands, handgrip 56 of the walking stick 50 embodiment may also be surrounded by a molded hand guard. The user may slide his arm into the helical arm support 54 and secure it to his arm by tensing the back of the wrist. When the wrist is relaxed, the arm may readily slide out of the helical arm support 54. This is an important feature of the arm support as a user could easily get his arm stuck in a standard arm support which surrounds the arm in the event of a fall. With the helical arm support 54, a user can easily and safely remove himself from the arm support 54 and the walking stick 50 simply by relaxing his wrist.

Figure 8:
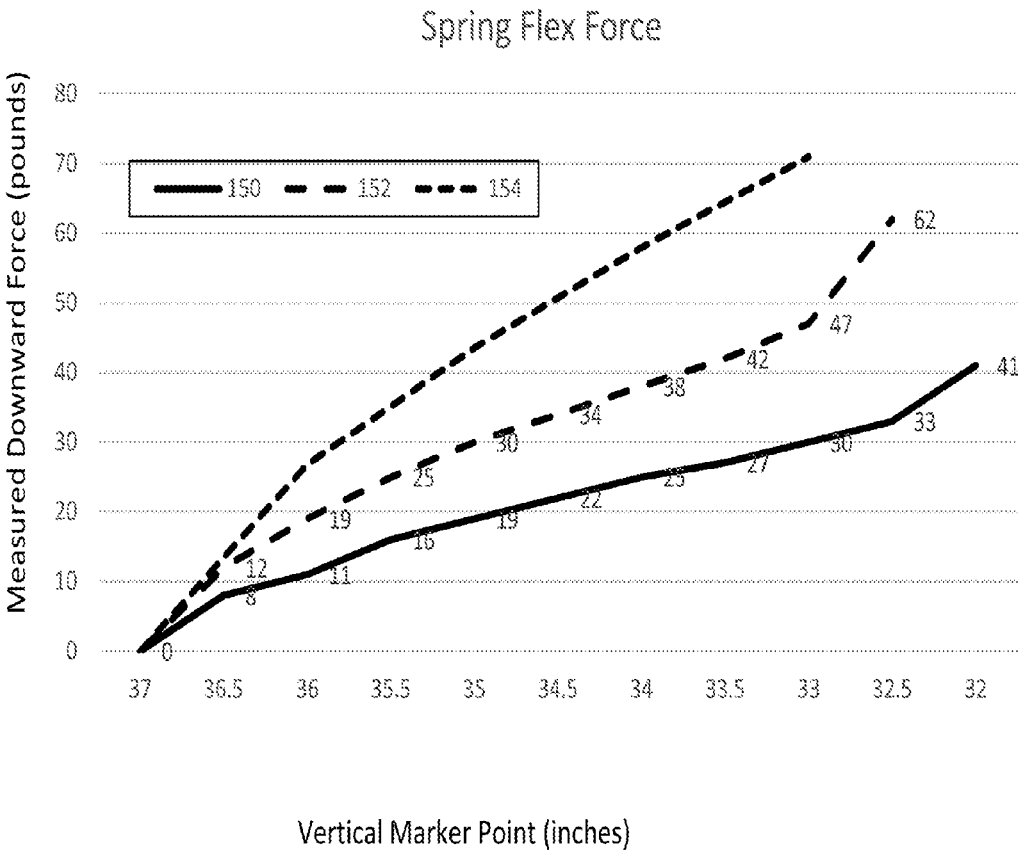
FIG. 8 is plot of force versus deflection for two embodiments of walking sticks of the present invention.

FIG. 8 illustrates, for three preferred embodiments of the walking stick of the present invention, the amount of spring force as a function of the amount of deflection of the flexure spring. Curve 150 represents the characteristics of a preferred embodiment walking stick for a person weighing in the range of approximately 100 lbs. Curve 152 represents the result for a preferred embodiment walking stick for a person weighing in the range of 150 to 225 lbs. Curve 154 represents the characteristics of a preferred embodiment walking stick for a person weighing in the range of approximately 300 pounds. Curve 150 indicates that a deflection of 1 inch produces a spring force of about 11 pounds. Similarly curve 152 indicates that a deflection of 1 inch produces a spring force of about 19 pounds. And curve 154 indicates that a deflection of 1 inch produces a spring force of about 27 pounds. These curves show that with a deflection greater than 4 inches, the relationship between deflection and force increases nonlinearly so that when the walking stick is heavily compressed, large spring forces result. When the transition to a higher spring force is reached, it is a signal to the athlete to push off or, in other words, to transfer their weight to the other stick.

The first flex point of the S-flexure spring mimics the flexibility of a human ankle. This spring is angled away from the user and angles the forces away from the center of the body for added stability and absorbs the downward forces to release on the rebound.

As depicted in FIG. 3, both the first flex point 116 and the second flex point 216 are oriented along the same axis. The additional upper curve 316 and the additional lower curve 416 are also aligned along that same axis. The second flex point of the S-flexure spring, the less flexible arch, controls direction of forces. The angle the foot is aligned relative to straight ahead varies from zero degrees for the medical versions of the walking stick to 45 degrees for the extreme sports or military versions of the walking stick.

There is an additional flex point in the foot. This mimics the motion of the "ball of the foot" of a human which keeps the foot flat when it makes contact with the ground while in use. On rebound it helps propel the walking stick forward to its next location.

The multi-part embodiments of the walking stick of the present invention, as illustrated in FIGS. 5 and 6, enable the use of interchangeable flexure springs with different spring force constants for different weight users, or with different shaped handgrips for use in different terrain. For example, the handgrip shown in FIG. 2 may be optimum for use on hard packed or paved surfaces which are moderately level, whereas a handgrip with an extension beyond the shaft of the walking stick may be better for use on extremely steep terrain. An extremely flared shoe with very high surface area may serve double duty as a walking stick base for soft, muddy, swampy terrain and as a canoe paddle.

Figure 9:
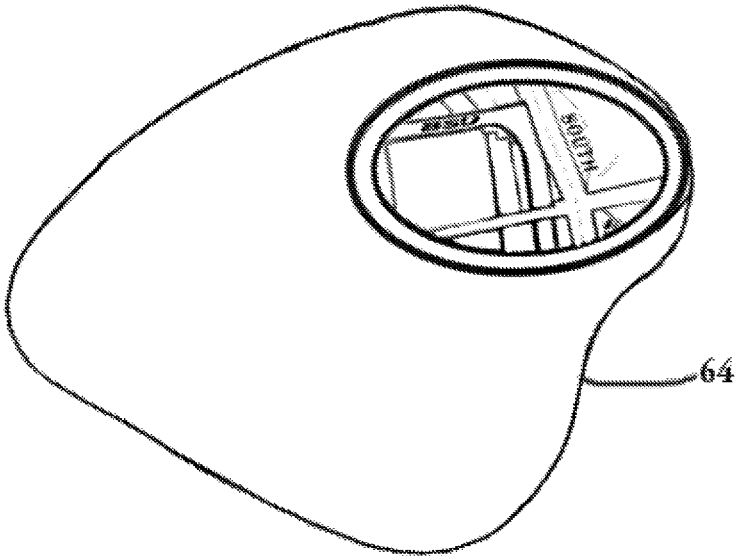
FIG. 9 illustrates a handgrip for a walking stick.

Referring to FIG. 9 and the preferred embodiment depicted therein, a handgrip 64 for a walking stick is illustrated. The handgrip 64 may be constructed to maintain a sealable cavity that the user may use to store small objects such as a map, a compass, a global positioning system (GPS), or the like. The handgrip may be constructed using any of several readily available means known to those skilled in the art of manufacturing polymer enclosures. Handgrip 64 may optionally be constructed of two or more materials via an over molding process. In a preferred embodiment, handgrip 64 is constructed of a glass reinforced acrylonitrile butadiene styrene (ABS) plastic covered with a rubberlike material such as Santoprene™ (manufactured by ExxonMobil of Irving, Tex.); this combination of materials will give the handgrip 64 strength and a soft feel to the user's touch. The handgrip 64 may also be optionally fitted with electronic sensors on the exterior of the handgrip 64 which allow for bio-monitoring of the user's vital signs; the sensors which can be attached to a power source and programmable logic controller located in the sealable cavity within the handgrip 64. The sensors can be constructed and deployed using well known methods, the details of which are omitted herein due to their well known nature. A very wide range of modules and electronics can be placed within this handgrip. These electronics may be powered conventionally through batteries or may be powered by small electric generators connected to the walking stick.

Figure 10:
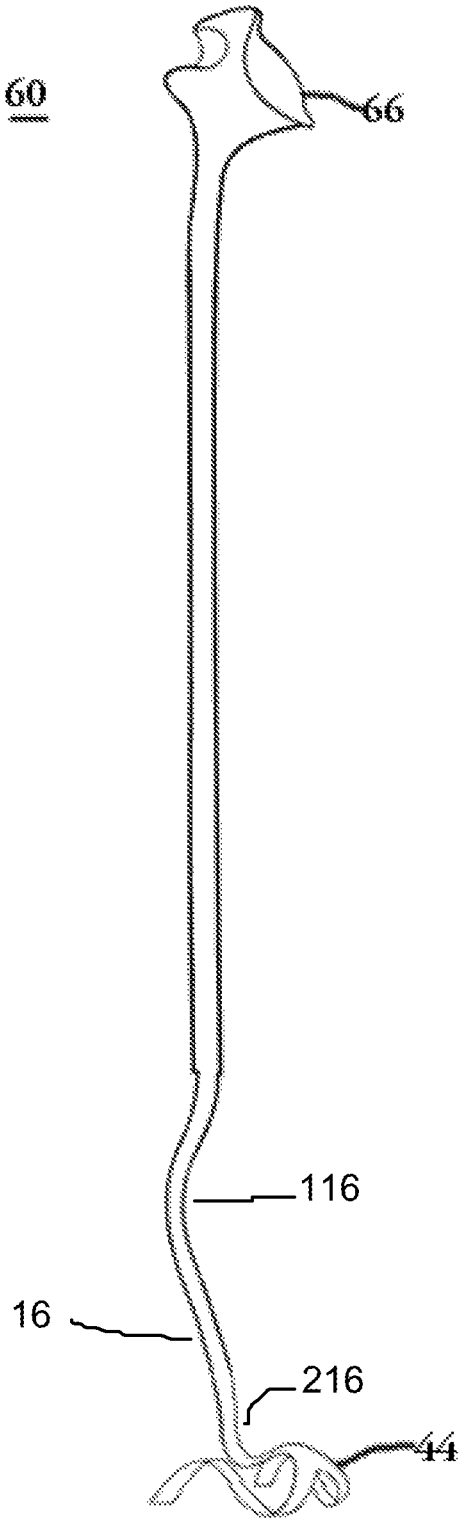
FIG. 10 illustrates a single piece walking stick.

An additional embodiment of the present invention is presented in FIG. 10. In this embodiment, a walking stick 60 similar to that depicted in FIG. 2 is presented. This walking stick may be made of the same materials as that of walking stick 10. The walking stick 60 depicted in FIG. 10 differs from walking stick 10 in that it has a handgrip 66 that is molded to conform to the palm-side surface of a human hand and it also has a bifurcated foot 44 to provide for additional stability. This bifurcated foot 44 provides for 4 contact points with the surface upon which the user is walking. These 4 contact points with the walking surface allow for great stability and balance for the user. A preferred usage for this embodiment of the present invention would be to assist a person (patient) with limited mobility to rise from a seated position and also to walk around. The patient may use either a single walking stick or a pair of walking sticks. The walking stick functionally allows the patient to use their upper body and weight to load the S-flexure spring. As those skilled in the art are aware, the walking stick of FIG. 10 may also be used as a hiking stick.

As the patient transfers from a sitting position to a standing position, the patient's upper body and weight compresses (loads) the spring; this stores energy. As the patient transfers to a standing position, stored energy is released providing additional lift to the patient.

During the loading process, a stop is reached. The stop is momentary and realized when the upper back of the foot, which acts as a fifth contact point, is engaged providing stability for the patient. The preferred range for the stop is 10 percent to 40 percent of the spring's working range and more preferably 15 percent to 25 percent of the spring's working range.

Figure 11:
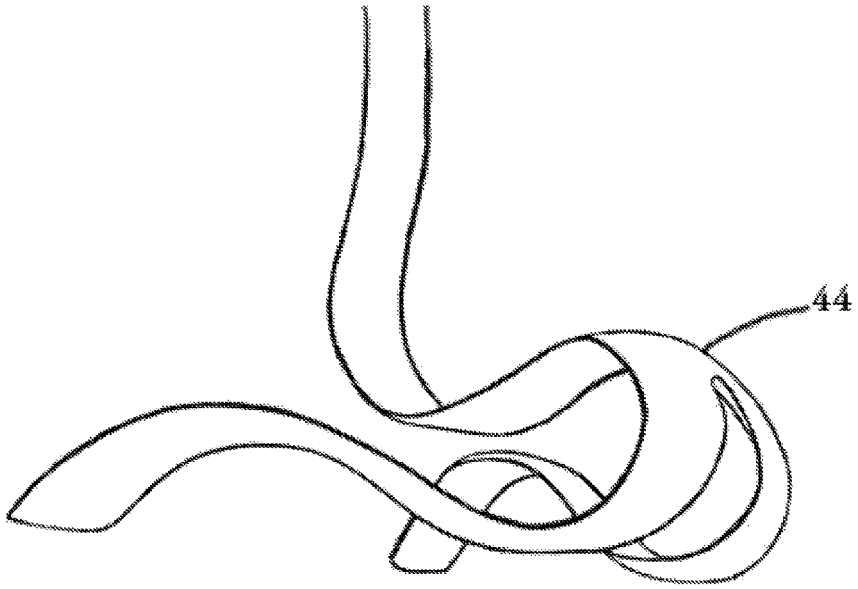
FIG. 11 illustrates the foot of a walking stick.

FIG. 11 depicts a close up view of the foot 44 of walking stick 60. This foot 44 makes contact with the walking surface at four points and at an additional point when the patient's weight compresses the walking stick.

Figure 12:
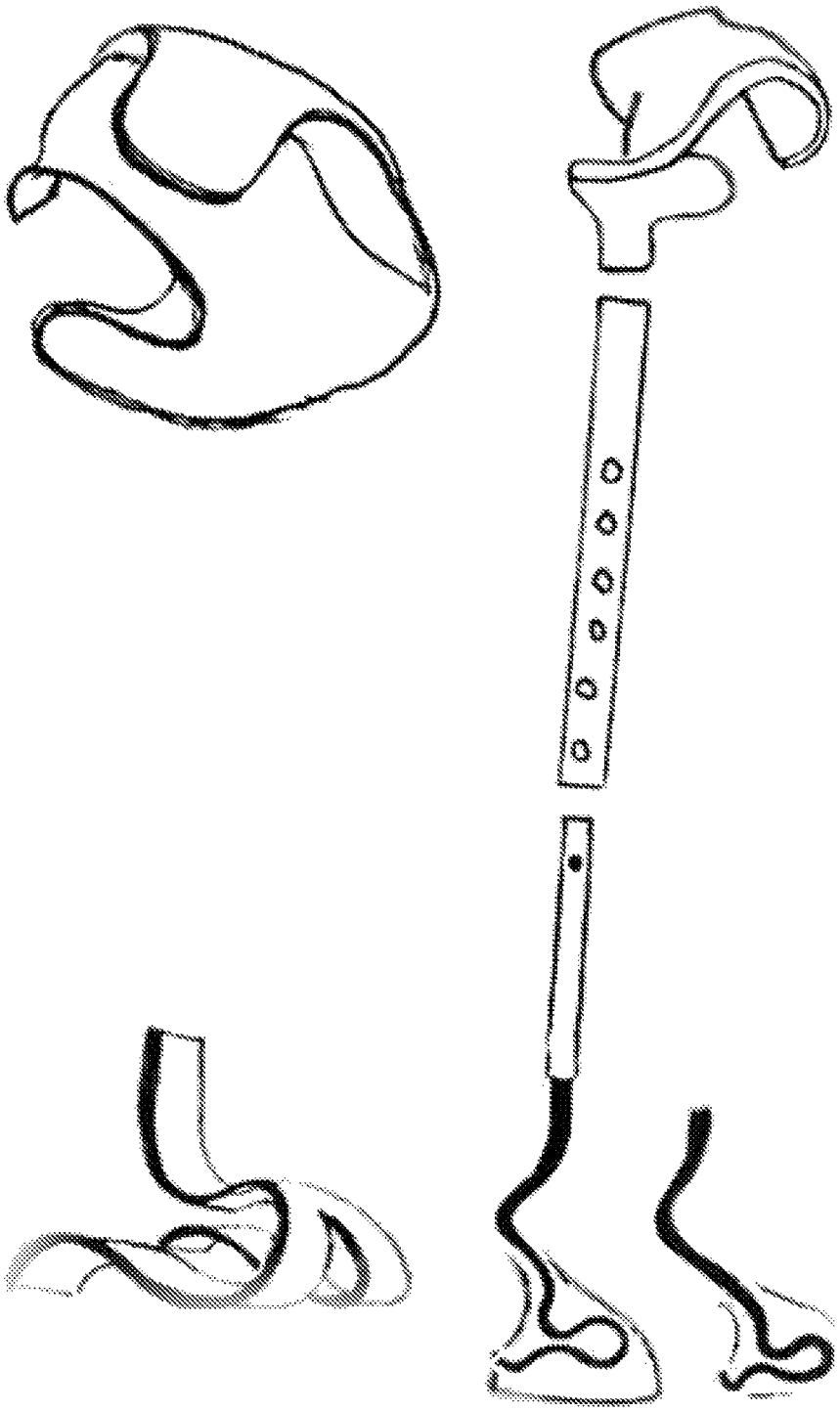
FIG. 12 illustrates a multi piece walking stick with various views of the walking stick hand grip, the walking stick foot, and shoes for the walking stick foot.

FIG. 12 depicts a multipiece walking stick 70 with a bifurcated foot and a shoe upon the foot. The shoe may provide additional stability to the user. Walking stick foot comprising a folded bifurcated spring which absorbs and distributes the downward forces placed on the walking stick when the user places the stick on the ground to spread the forces evenly across the ground as well as keeping the foot solidly centered at the base of the walking stick. As the user's weight is applied to the walking stick, the second flex point of the spring (located approximately where the foot attaches to the walking stick shaft, contacts the ground and limits the flexibility of device. This is especially important for people using the walking stick to assist with mobility.

A shoe to cover the foot may have outer spring tips, embedded in the over-molded shoe, which spread the applied forces evenly and effectively across the base of the walking stick to the ground.

Figure 13:
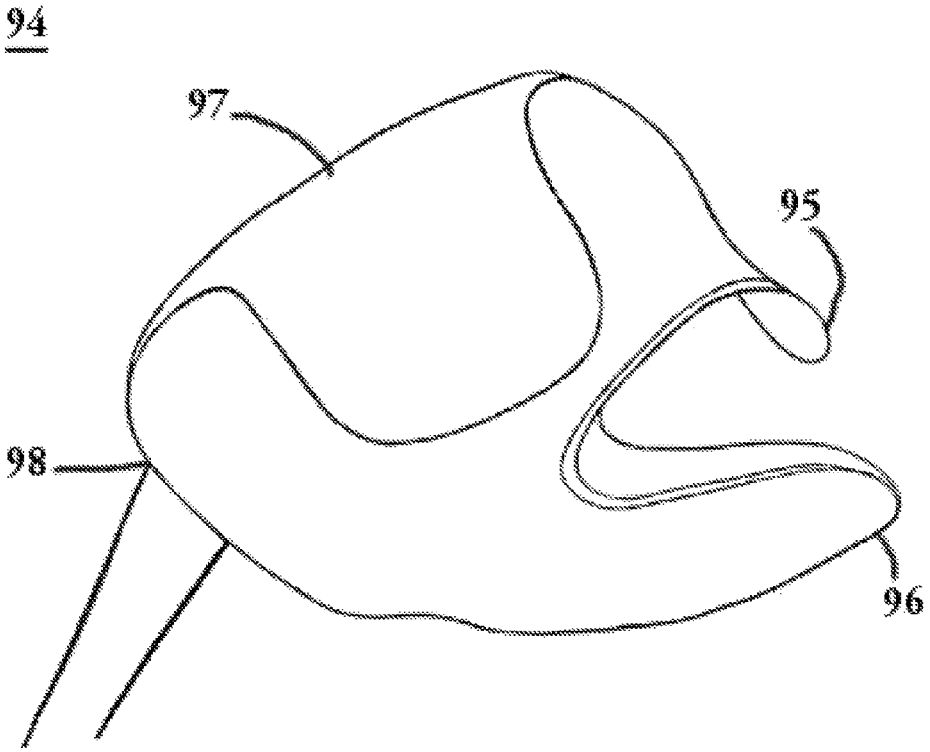
FIG. 13 illustrates an alternative hand grip for a walking stick.

FIG. 13 provides additional details of a preferred embodiment of a handgrip 94 for the walking stick. The grip of the walking stick maintains a flexible consistency which allows it to flex inward as a user applies more pressure to it. It is good for exercising the forearms and reducing user fatigue.

The personalisible grips are angled to fit the persons relaxed out reached hands with thumbs facing slightly upward about 15 degrees+ or −5 degrees relative to the walking surface.

Detailed points of a preferred embodiment of the grip depicted in FIG. 13 include a finger flexor 95, a thumb flexor 96, a sheath covering the back of the user's hand 97, and a shaft connection 98. An optional module housing structure is not depicted.

Emplacements are available for a variety of sensors to collect data about the environment or the physical condition of the user.

An additional embodiment of the present invention would be a walking stick similar to that of walking stick 10 of FIG. 2 which uses the bifurcated foot of the walking stick of FIG. 10.

The invention has been described in detail with particular reference to certain preferred embodiments thereof, but it will be understood that variations and modifications can be effected within the spirit and scope of the invention.

I claim:

1. A walking stick comprising, a straight shaft terminated with a handgrip at an upper end, and with an S-flexure spring at a lower end, said S-flexure spring having a free end, distal from said straight shaft, so that said free end will contact the surface upon which a person, gripping said handgrip, is standing, said free end having an attached foot providing means for preventing said free end from sliding on the surface upon which said person is standing, wherein said free end is angled away from the person at an angle of approximately 10 to 45 degrees, wherein said S-flexure spring having a first curve and a second curve, wherein the first curve of the S-flexure spring comprises a pair of curves, one entering and one leaving the first curve of the S-flexure spring, wherein the second curve of the S-flexure spring comprises a pair of curves, one entering and one leaving the second curve of the S-flexure spring, wherein the S-flexure spring further comprises an inflection point, said inflection point located between the first and second curves of the S-flexure spring.

2. The walking stick of claim 1 wherein said S-flexure spring has a spring constant in the range between 5 and 50 pounds/inch.

3. The walking stick of claim 2 wherein said straight shaft, said handgrip, and said S-flexure spring are integrally formed in a single part of a common material wherein said S-flexure spring further having an additional upper curve and an additional lower curve.

4. The walking stick of claim 3 wherein the handgrip meets the straight shaft in a manner such that the person's hand will be oriented in a horizontal position and rotated inwardly towards the user slightly to a position of approximately 10 to 45 degrees.

5. The walking stick of claim 4 wherein the handgrip is molded to fit the hand of the person held at an ergonomically correct gripping position.

6. The walking stick of claim 3 wherein the handgrip meets the straight shaft in a manner such that the person's hand will be oriented in a horizontal position and rotated inwardly towards the user slightly to a position of approximately 15 to 30 degrees.

7. The walking stick of claim 3 wherein the first curve, the second curve, the additional upper curve, and the additional lower curve are all aligned along the same axis.

8. The walking stick of claim 7 wherein said common material comprises a plurality of layers of a composite material.

9. The walking stick of claim 8 wherein said composite material is chosen from the group consisting of fiberglass and carbon fiber.

10. The walking stick of claim 7 wherein said foot is bifurcated.

11. The walking stick of claim 2 wherein said straight shaft, said handgrip, and said S-flexure spring are separate parts with means for connecting together.

12. The walking stick of claim 11 wherein said S-flexure spring comprises a plurality of layers of a composite material.

13. The walking stick of claim 12 wherein said composite material is chosen from the group consisting of fiberglass and carbon fiber.

14. The walking stick of claim 13 wherein said straight shaft further comprises an upper section and a lower section with means for connecting said upper section to said lower section so that the overall length is adjustable.

15. The walking stick of claim 11 wherein said S-flexure spring is made from a material selected from the group consisting of a metal, a wood, a plastic, and a ceramic.

16. The walking stick of claim 2 wherein the radius of said upper curve is approximately 6 inches and the radius of said lower curve is approximately 1 inch.

17. A walking stick comprising, a straight shaft terminated with a handgrip at an upper end, and with an S-flexure spring at a lower end, said S-flexure spring having a free end, distal from said straight shaft, so that said free end will contact the surface upon which a person, gripping said handgrip, is standing, said free end having an attached foot providing means for preventing said free end from sliding on the surface upon which said person is standing, wherein said S-flexure spring having a first curve, a second curve, an additional upper curve and an additional lower curve, wherein the first curve of the S-flexure spring comprises a pair of curves, one entering and one leaving the first curve of the S-flexure spring, wherein the second curve of the S-flexure spring comprises a pair of curves, one entering and one leaving the second curve of the S-flexure spring, wherein the S-flexure spring further comprises an inflection point, said inflection point located between the first and second curves of the S-flexure spring, wherein the angle the foot is aligned relative to straight ahead varies from zero degrees to 45 degrees.

* * * * *